US005854990A

United States Patent [19]

Reckzügel et al.

[11] Patent Number: 5,854,990

[45] Date of Patent: Dec. 29, 1998

[54] PROCESS AND APPARATUS FOR CONTROLLING THE COMBUSTION COURSE IN AN OTTO COMBUSTION ENGINE

[75] Inventors: Christoph Reckzügel, Hohenstedt; Hans-Hubert Hemberger, Notzingen; Winfried Stiltz, Weinstadt, all of Germany

[73] Assignee: Daimler-Benz AG, Germany

[21] Appl. No.: 659,516

[22] Filed: Jun. 6, 1996

[30] Foreign Application Priority Data

Jun. 6, 1995 [DE] Germany ..... 195 20 605.3

[51] Int. Cl.[6] ..... G06G 9/10

[52] U.S. Cl. ..... 701/101; 701/106; 701/102; 73/115; 123/488; 123/674

[58] Field of Search ..... 364/431.01, 431.03, 364/431.04, 431.07, 431.12, 431.061, 431.054, 424.034; 123/361, 480, 488, 422, 423, 492, 493, 436, 478, 419, 414; 73/115, 116, 117.3; 393/20, 911, 913, 22, 905, 23; 701/99, 110, 115, 116, 111, 102, 107, 106, 101

[56] References Cited

U.S. PATENT DOCUMENTS

| | | | |
|---|---|---|---|
| 3,888,220 | 6/1975 | Bigalke et al. | 123/414 |
| 4,161,162 | 7/1979 | Latsch et al. | 123/414 |
| 4,178,891 | 12/1979 | Latsch et al. | 123/419 |
| 4,381,748 | 5/1983 | Eckert et al. | 123/414 |
| 4,987,888 | 1/1991 | Funabashi et al. | 364/431.07 |
| 5,020,360 | 6/1991 | Brosi et al. | 73/115 |
| 5,021,960 | 6/1991 | Manaka et al. | 364/431.01 |
| 5,041,976 | 8/1991 | Marko et al. | 364/424.034 |
| 5,093,792 | 3/1992 | Taki et al. | 364/431.01 |
| 5,200,898 | 4/1993 | Yuhara et al. | 364/431.054 |
| 5,247,445 | 9/1993 | Miyano et al. | 364/431.12 |

FOREIGN PATENT DOCUMENTS

| | | |
|---|---|---|
| 0 114 490 | 8/1984 | European Pat. Off. . |
| 31 28 245 | 1/1983 | Germany . |
| 42 28 053 | 4/1993 | Germany . |

OTHER PUBLICATIONS

Patent Abstract of Japan, M–1497 Oct. 18, 1993, vol. 17/No. 572, 5–1633996(A), dated Jun. 29, 1993.

*Primary Examiner*—Jacques H. Louis-Jacques
*Attorney, Agent, or Firm*—Evenson, McKeown, Edwards & Lenahan P.L.L.C.

[57] ABSTRACT

The invention provides a process and apparatus for controlling combustion in an Otto combustion engine in which the control variables that control combustion are determined for a particular power cycle as a function of the detected combustion course of a preceding power cycle. According to the invention, a desired burn-through function value for a particular power cycle is precalculated based on values of pertaining influence factors detected in a preceding power cycle, to determine an actual burn-through function value of the particular power cycle in real time. The desired burn-through function is compared with the actual burn-through function and actualized values for the burn-through function influence factors are determined. These factors are used to determine the control variable values for a subsequent power cycle.

7 Claims, 1 Drawing Sheet

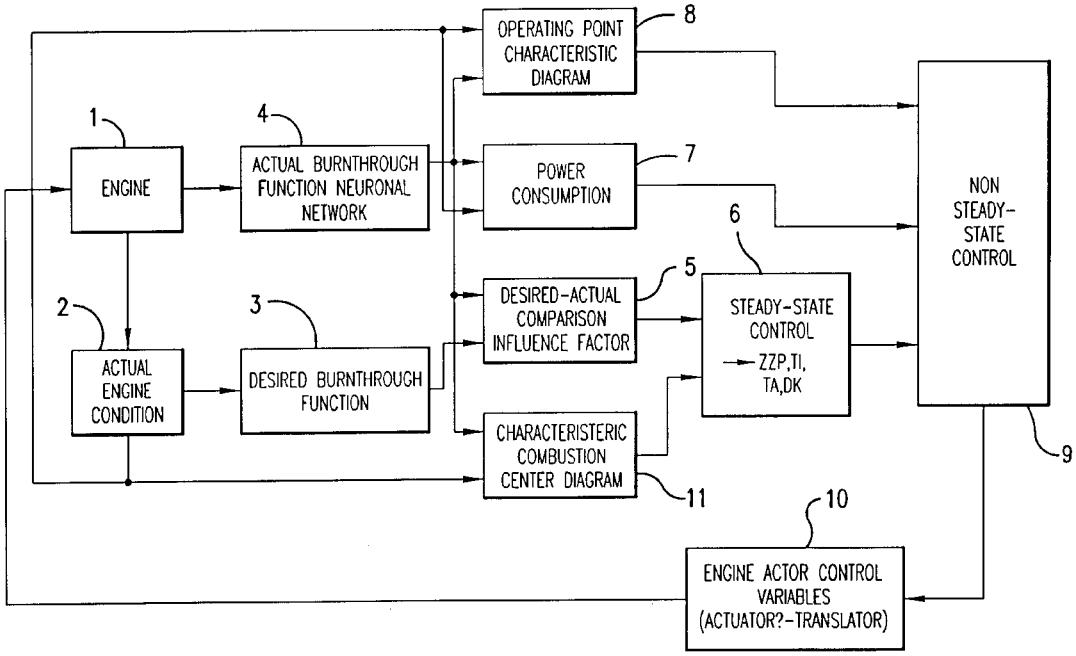

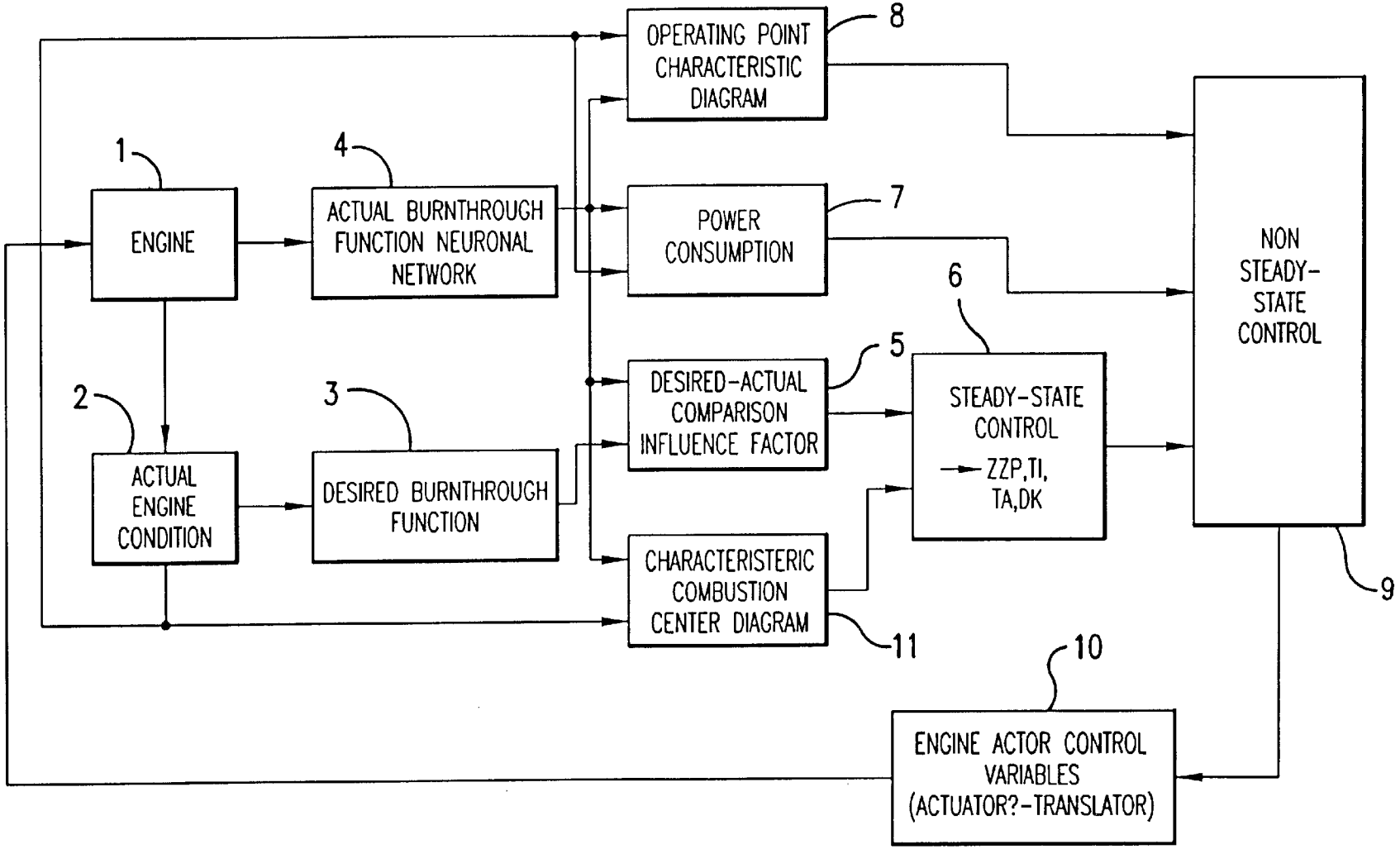
NON STEADY-STATE CONTROL
9
STEADY-STATE CONTROL
ZZP,TI, TA,DK
6
ENGINE ACTOR CONTROL VARIABLES (ACTUATOR?-TRANSLATOR)
10
OPERATING POINT CHARACTERISTIC DIAGRAM
8
POWER CONSUMPTION
7
DESIRED-ACTUAL COMPARISON INFLUENCE FACTOR
5
CHARACTERISTERIC COMBUSTION CENTER DIAGRAM
11
ACTUAL BURNTHROUGH FUNCTION NEURONAL NETWORK
4
DESIRED BURNTHROUGH FUNCTION
3
ENGINE
1
ACTUAL ENGINE CONDITION
2

PROCESS AND APPARATUS FOR CONTROLLING THE COMBUSTION COURSE IN AN OTTO COMBUSTION ENGINE

BACKGROUND AND SUMMARY OF THE INVENTION

This invention relates to a process and apparatus for controlling the combustion in an Otto combustion engine. In conventional engine combustion controls, it is known to make a preliminary determination of engine control variables, such as the ignition point, the injection start, the injection end and the throttle valve angle, by accessing a plurality of characteristic curves and characteristic diagrams. By detecting certain engine operating parameters, such as the intake air mass, engine temperature, rotational speed etc, these engine control variables are calculated during the charge cycle phase. With the exception of the known knock control and lambda control, no alignment takes place with the actual combustion course which does not start before the high-pressure cycle. Thus, during lambda control, it is not the combustion course, but rather the exhaust gas, which is analyzed.

More specifically, to control combustion in Otto engines, it is known to determine engine control variable values for a subsequent power cycle by means of a control device, as a function of the combustion course of a preceding power cycle, using measured actual condition variables to access stored characteristic diagrams. Conventionally, in this case, the detected instantaneous values of one or several measurable variables representative of the course of the combustion are used directly as feedback values which are compared in the control unit with desired values determined from stored characteristic diagrams. From the control deviation determined in this manner, the control elements for the next power cycle are controlled so as to reduce the control deviation. Thus, for example, German Patent Document DE 31 28 245 A1, discloses a process for controlling combustion in internal-combustion engines in which the course of the combustion chamber pressure is detected and is compared with a stored characteristic curve. Determined deviations are then controlled by adjusting the mixture formation and/or the ignition system of the internal-combustion engine. For cylinder-specific engine control, it is known to store individual characteristic diagrams for the individual cylinders; see German Patent Document DE 42 28 053 A1.

A control device for an internal-combustion engine disclosed in U.S. Pat. No. 5,200,898, includes a neuronal network to which information is periodically fed concerning the actual throttle valve angle and its rate of change. The neuronal network performs a preliminary calculation of the throttle valve opening angle, which is used by the control device, among other things, for the control of a fuel injection unit.

In an ignition system for an internal-combustion engine disclosed in European Patent Document EP 0 114 490 A2, a parameter representative of the fuel load of the operating space is measured before ignition is triggered in order to estimate the combustion characteristics for the current power cycle and a suitable ignition point, to reduce fluctuations in the generated engine torque from one power cycle to the next.

Japanese Patent Document JP 5-163996 (A) discloses an engine control in which the engine torque is controlled to a desired value by adjustment of the air intake quantity and the ignition point.

U.S. Pat. No. 4,987,888 discloses a combustion control in which combustion-relevant actual-condition variables are detected and, as a function thereof, the operating conditions (for example, air intake quantity) in a later power cycle are estimated. The estimated operating conditions are used to determine the combustion-relevant control variable values.

The object of the invention is to provide a process and apparatus by means of which a comparatively precise control of the combustion course in an Otto combustion engine is achieved, taking into account the thermodynamics of the combustion operation as extensively as possible.

This object is achieved by the process and apparatus according to the invention, in which the control variable values for a subsequent power cycle are determined based on actualized values of factors which influence the so-called "burn-through function" (the integral of the combustion course curve with respect to time, or with respect to the crank angle). The actualized influence factor values are obtained by comparing a desired time precalculated during the charge cycle phase of a power cycle with an actual burn-through function evaluated in real-time during the high-pressure phase of a power cycle. The desired burn-through function value for a particular power cycle is precalculated in this case based on detected or derived values of the burn-through function influence factors, which are representative of the actual engine condition of a preceding power cycle. In the case of an engine with several cylinders, this preferably takes place separately for each individual cylinder.

Since the burn-through function reflects the thermodynamics of the combustion operation more precisely than do individual measurable variables, in comparison to engine controls which are based only on the observation of individual ones of such measurable variables, much more precise control of the combustion course is achieved. Control variables for the next power cycle which are to be influenced may be, for example, the start of injection, the end of injection, the ignition points and the throttle valve angle. To determine the actual engine operating condition, engine parameters such as air mass, temperature and rotational speed can be used, as well as additional measured variables such as the residual exhaust gas content and the lambda value. In this manner, actual fuel conversion into thermal energy is observed, and can be controlled taking into account the given marginal conditions, such as the driver's intent and operating requirements.

By means of the process according to the invention, cyclical fluctuation in the instantaneous power point can be evaluated and worked into the control strategy. In particular, the transition behavior of the engine control in transient operation is improved significantly in comparison to conventional controls. In addition, in this type of combustion control, the large number of characteristic curves and characteristic diagrams which are otherwise required for conventional engine controls, will no longer be necessary.

Individual control of the cylinders permits optimization of each individual cylinder while taking into account the cylinder synchronization. Because of the real-time evaluation of the actual burn-through function, a separate knock sensor is not required. Series divergences, manufacturing tolerances, ignition and firing differences, aging phenomena as well as effects of combustion chamber deposits may be taken into account in the control itself without the requirement of safety supplements, such as retarding an ignition point.

In a further embodiment of the invention, a characteristic-diagram-based determination of the position of the combustion center is used by means of the actual engine condition and the actual burn-through function and for the steady-state engine control. For this purpose, the control device which carries out the process may have a corresponding unit for determining the position of the combustion center.

In another embodiment of the invention, a transient control is superimposed on the steady-state control. For such transient control, in addition to the steady-state controller output signal, the information concerning the instantaneous operating point and/or the instantaneous engine power or the engine consumption are taken into account.

In yet another embodiment of the invention, the actual burn-through function is evaluated without difficulty in real time, by means of a neuronal network. For this purpose, the generalizing and learning capacity of the network as well as its self-organization function can be utilized for the independent establishment of a relationship between an input signal to be classified and an intended output signal. The use of such artificial intelligence eliminates the need to solve the thermodynamic equations characteristic of the burn-through function in a high-expenditures manner by means of a computer in real time, as well as the need to iterate them by way of the crank angle.

Other objects, advantages and novel features of the present invention will become apparent from the following detailed description of the invention when considered in conjunction with the accompanying drawings.

BRIEF DESCRIPTION OF THE DRAWINGS

The single figure of the drawing is a block diagram of a combustion control for an Otto combustion engine

DETAILED DESCRIPTION OF THE DRAWINGS

The control device illustrated in the Figure monitors the actual condition of the combustion course of the engine 1 to be controlled. For this purpose, the actual-condition detecting unit 2 detects measured variables relevant to the combustion operation and calculates the remaining relevant engine parameters, particularly the engine rotational speed, the starting temperature and pressure of a power cycle, as well as the residual exhaust gas content and the lambda value. Using these detected quantities, a calculating unit 3 precalculates the desired burn-through function in the charge cycle phase of the respective power cycle.

As is known, the burn-through function is defined as an integral of the combustion course with respect either to time or the crank angle. To precalculate the burn-through function, influence factor equations are used, which describe the separate influences of the individual operating parameters on the action of the engine. Therefore, in order to determine how the burn-through function reacts to changes of the operating parameters, the engine type is indexed beforehand at suitable operating points, and systematic series of measurements are carried out until the influence factor equations are determined with sufficient certainty. The precalculation is based on suitable reference points, of which several are provided, along the complete operating range.

In parallel to the precalculation of the desired burn-through function value in the unit 3, a neuronal network 4 receives as inputs, one or several detected quantities which are representative of the combustion course, such as the course of the combustion chamber pressure as a function of the crank angle and/or the lambda value and the exhaust gas temperature. Based on these inputs, the neuronal network 4 evaluates the actual burn-through function in real time, during the high-pressure phase of the respective power cycle. Use of artificial intelligence permits ready determination of the actual burn-through function in real time, eliminating the need for a highly calculation-intensive solution of the underlying thermodynamic equations, and an iteration by way of the crank angle. It is known that the determined burn-through function value can be used to derive the quantities relevant to such as combustion duration, apparent ignition lag, residual exhaust gas content and internal medium pressure. In addition, simultaneous knock detection is possible, which makes a separate knock sensor unnecessary.

The data of the precalculated desired burn-through function from the calculating unit 3, and of the determined actual burn-through function from the neuronal network 4 are supplied to a subsequent comparison unit 5, which carries out a desired-value actual-value comparison of the burn-through functions. By reversing the functional relationship used for precalculation of the burn-through function, the comparison unit 5 determines the actual values of the influence factors which determine the burn-through function (such as the ignition point, the lambda value, the starting temperature and pressure, the residual exhaust gas content and the rotational speed) as a function of the relevant burn-through function parameters (such as the combustion duration, the apparent ignition lag and form parameters), that is, the slope adaptation of the burn-through function curve, in such a manner that these actual values fit the actual real time burn-through function determined by the neuronal network 4.

This information concerning the optimal instantaneous influence factor values is output from the comparison unit 5 to a steady-state control unit 6, which provides optimal control variables (the ignition point (ZZP), the injection start (ti), the injection end (ta) and the throttle valve angle (DK)), using the apparent ignition lag as well as the combustion center position as control criteria to determine the ignition point, and using the apparent ignition lag, the combustion duration, and the form parameter of the burn-through function as control criteria for the lambda value. Information concerning the combustion center position is supplied to the steady-state control 6 by a unit 11 which accesses a characteristic diagram stored therein, based on the actual burn-through function which it receives from the neuronal network 4 and the actual measured variables and engine parameters for the actual-condition detecting unit 2, to determine the combustion center position.

The output signal of the steady-state control 6 is fed to a transient control 9 which may comprise a fuzzy logic control unit or a conventional PI(D) control unit. Additional input information provided to the transient control 9 consists of the actual power and actual consumption in the particular power cycle, as determined by a unit 7 which receives input information concerning the actual burn-through determination from the neuronal network 4, and the actual engine condition data from the actual condition detecting unit 2. By means of the same input information, a unit 8 which is arranged in parallel to the unit 7 queries a characteristic operating point diagram stored therein, to determine weighting factors for the type of engine control desired by the driver; that is, for the operating point with respect to the power, the consumption and the emission. In this case, the driver's requirement is detected by reference to the throttle valve change, and by observation of past power cycles and the possible prediction of the future power cycle. By including this information, the transient control unit 9, may correct the output signal of the steady-state control as required by taking into account the driver's intention and the respective operating point requirements, the whole above-described control event taking place individually while taking into account the cylinder synchronization for each cylinder. In an output-side unit 10, the output signal of the transient control unit 9 is converted into corresponding engine control variable values, which are provided to the engine 1 for a subsequent power cycle.

The described control concept permits a controlled multivariable control in which operating point changes are assigned to a corresponding control variable change. The actual fuel conversion into thermal energy is tracked and is controlled based on the given marginal conditions, such as the driver's intention and the operating point requirements, thereby implementing an optimal control variable adaptation. By the use of a neuronal network to determine the actual burn-through function and/or a fuzzy control unit as a transient control, the real-time application of this control is facilitated. An operating point change in response to a driver's input is thus readily adapted to the requirements for desired power, consumption, emission, smooth running and noise. Control variables are optimized individually for each cylinder by a thermodynamic analysis and evaluation of the actual burn-through function obtained from a combustion-course-determining quantity, such as the combustion chamber pressure course, by means of the neuronal network and the precalculated desired burn-through function.

It is understood that the control units individually illustrated in the figure do not have to be separate components. Rather, they are to be considered individual functional units for illustrating the control sequence which, in a suitable manner, are combined to form respective control components.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Process for controlling combustion in an Otto combustion engine, wherein control variables for controlling a combustion course for a particular power cycle are determined using a control device, as a function of a detected combustion course of a preceding power cycle, said process comprising the steps of:

precalculating a desired value for a burn-through function for a particular power cycle during its charge cycle phase, based on actual values of burn-through function influence factors detected during a preceding power cycle, by integrating the combustion course during the preceding power cycle with respect to either time or crank angle;

determining in real time an actual burn-through function value during a high-pressure phase of a particular power cycle using a neuronal network which receives as inputs one or several quantities representative of the combustion course;

comparing the precalculated desired burn-through function value with the actual burn-through function value; and based on a result of said comparing, controlling combustion in the Otto combustion engine based on determined actualized values for the burn-through function influence factors on which a combustion-controlling determination of control variable values for a subsequent power cycle is based.

2. Process according to claim 1 wherein actualized values for the burn-through function influence factors and a combustion center position determined for the particular power cycle based on a characteristic diagram are used to determine steady-state-operation-controlled control variable values.

3. Process according to claim 2 wherein the steady-state-operation-controlled control variable values are changed into transient operation control variable values, taking into account at least one of an instantaneous operating point, a determined instantaneous engine power, a determined instantaneous consumption.

4. Device for controlling combustion in an Otto combustion engine, comprising:

a first unit for detecting actual engine condition variables;

a second unit whose output signal controls adjustment of engine control elements;

a third unit for precalculating a desired value of a burn-through function during a power cycle charge cycle phase, based on actual engine condition variables detected by said first unit by integrating the combustion course during the preceding power cycle with respect to either time or crank angle;

a fourth unit for determining an actual burn-through function value during a power cycle high-pressure phase using a neuronal network which receives as inputs one or several quantities representative of the combustion course; and a fifth unit for determining influence factor values associated with the determined actual burn-through function values, by a comparison of the precalculated desired burn-through function value with the determined actual burn-through function value, an output of said fifth unit being provided to said second unit;

a sixth unit for controlling combustion in the Otto combustion engine based on determined actualized values for the burn-through function influence factors on which a combustion-controlling determination of control variable values for a subsequent power cycle is based.

5. Control device according to claim 4 further comprising a seventh unit having an output which is connected to the second unit, in parallel to the fifth unit which determines influence factor values, for characteristic-diagram-based determination of a combustion center position using the determined actual burn-through function value and detected actual engine condition variables.

6. Control device according to claim 5 wherein the second unit comprises:

a steady-state control having an output connected to a transient control; and at least one of a eighth unit for calculating actual power and consumption, and an ninth unit connected in parallel with the steady-state control and having an output connected to the transient control unit, for characteristic-diagram-based operating point determination;

wherein output signals of the fourth unit for determining the actual burn-through function value and of the first unit for detecting the actual condition variables are supplied to each of said units.

7. Control device according to claim 6 wherein the fourth unit for determining the actual burn-through function value comprises a neuronal network.

* * * * *